US006408933B2

(12) United States Patent
Fukuoka et al.

(10) Patent No.: US 6,408,933 B2
(45) Date of Patent: Jun. 25, 2002

(54) HEAT EXCHANGER HAVING ATTACHMENT STRUCTURE OF ELASTIC SUPPORT MEMBER

(75) Inventors: Shokichi Fukuoka, Nishio; Yoshiharu Kajikawa, Hekinan; Akio Hirano, Toyoake; Yasuaki Tsukagoshi, Nishio; Atsushi Yazawa; Yasuhiro Ando, both of Okazaki; Fumiaki Nakamura, Kariya; Hideo Harada, Okazaki; Shinichi Inagaki, Kasugai, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/876,660

(22) Filed: Jun. 7, 2001

(30) Foreign Application Priority Data

| | | |
|---|---|---|
| Jun. 8, 2000 | (JP) | 2000-172110 |
| Aug. 25, 2000 | (JP) | 2000-256531 |
| Jan. 11, 2001 | (JP) | 2001-004025 |

(51) Int. Cl.[7] ..... F28F 9/00
(52) U.S. Cl. ..... 165/67; 165/69; 180/68.4
(58) Field of Search ..... 165/67, 69; 180/68.4

(56) References Cited

U.S. PATENT DOCUMENTS

| | | | | |
|---|---|---|---|---|
| 1,485,178 A | * | 2/1924 | Frank | 165/69 |
| 3,123,170 A | * | 3/1964 | Bryant | 165/67 |
| 4,651,839 A | * | 3/1987 | Isobe | 180/68.4 |
| 5,558,310 A | * | 9/1996 | Furuie et al. | 180/68.4 |
| 5,570,738 A | * | 11/1996 | Christensen | 165/67 |
| 5,632,328 A | * | 5/1997 | Sawyer et al. | 165/69 |
| 5,996,684 A | * | 12/1999 | Clifton et al. | 165/69 |
| 6,000,460 A | * | 12/1999 | Yamanaka et al. | 165/67 |

FOREIGN PATENT DOCUMENTS

| | | |
|---|---|---|
| JP | Y2-7-52329 | 11/1995 |
| JP | A-9-30244 | 2/1997 |

* cited by examiner

*Primary Examiner*—Henry Bennett
*Assistant Examiner*—Terrell McKinnon
(74) *Attorney, Agent, or Firm*—Harness, Dickey & Pierce, P.L.C.

(57) ABSTRACT

In a heat exchanger having a side plate for reinforcing a core portion, after an elastic support member for supporting the core portion is inserted between opposite walls of the side plate, a part of the opposite walls having a slit portion is plastically deformed at a position around the slit to form a protrusion. The protrusion protrudes toward the support member to be engaged with a recess of the elastic support member. Further, the silt is provided to penetrate through each opposite wall without being opened to an outer peripheral end of the side plate. Accordingly, the support member can be readily attached to the side plate, while it can prevent the side plate from being deformed in a brazing.

13 Claims, 8 Drawing Sheets

HEAT EXCHANGER HAVING ATTACHMENT STRUCTURE OF ELASTIC SUPPORT MEMBER

CROSS-REFERENCE TO RELATED APPLICATION

This application is related to Japanese Patent Applications No. 2000-172110 filed on Jun. 8, 2000, No. 2000-256531 filed on Aug. 25, 2000, and No. 2001-4025 filed on Jan. 11, 2001, the contents of which are hereby incorporated by reference.

BACKGROUND

1. Field of the Invention

The present invention relates to an attachment structure of a support member made of an elastic material in a heat exchanger. The attachment structure is suitably used for a vehicle heat exchanger such as a condenser.

2. Description of Related Art

In a conventional heat exchanger described JP-Y2-7-52329, plural L-shaped recess portions are provided in a metal side plate of the heat exchanger, plural protrusion claws are provided in an elastic attachment member, and the protrusion claws are engaged with the L-shaped recess portions so that the attachment portion is attached to the side plate. However, because each of the L-shaped recess portions is opened at an outer peripheral end of the side plate, rigidity of the side plate around the recess portions is reduced and the outer peripheral end of the side plate is readily deformed. Thus, when the side plate is heated in a brazing, the side plate around the L-shaped recess portions is readily deformed due to a thermal stress generated in the side plate.

SUMMARY OF THE INVENTION

In view of the foregoing problems,: it is an object of the present invention to provide a heat exchanger in which an elastic support member is readily inserted into a side plate while a deformation of the side plate is prevented in a brazing.

According to the present invention, in a heat exchanger having a core portion for performing a heat exchange between both fluid, and a side plate disposed at an end of the core portion for reinforcing the core portion, the side plate has a pair of opposite walls disposed opposite to each other, and an elastic support member for supporting the core portion is inserted between the opposite walls of the side plate to have an inserted portion inserted into the side plate. In the heat exchanger, the inserted portion of the support member has a recess portion recessed to an inner side, the opposite walls have a protrusion portion protruding to an inner side between the opposite walls, and the protrusion portion is provided to be engaged with the recess portion of the support member.

Accordingly, the support member can be readily fitted into the side plate by elastically deforming a part of the opposite walls after the inserted portion of the support member is inserted into the side plate. Further, it is unnecessary to form a recess recessed from an opened peripheral end of the side plate. Thus, a deformation of the side plate in a brazing can be prevented while the support member can be readily attached into the side plate. In addition, because the recess portion is provided in the support member, a material cost for forming the support member can be relatively reduced.

Preferably, each of the opposite walls has a slit penetrating through each opposite wall, and the protrusion portion is provided in the opposite walls at a position proximate to the slit to protrude to the inner side between the opposite walls. Therefore, the protrusion portion can be readily formed by plastically deforming a part of the opposite walls.

The support member includes the inserted portion inserted between the opposite walls to be fixed therebetween, a mount guide portion being attached to a vehicle body, and a vibration absorbing portion between the inserted portion and the mount guide portion. In addition, the inserted portion of the support member has a reinforcement portion made of a material harder than the elastic material. Accordingly, it is possible to reduce a hardness of the support member, while it can prevent the inserted portion of the support member from being detached from the side plate. As a result, when the heat exchanger is mounted on a vehicle, the support member can sufficiently absorb a vibration transmitted from the vehicle to the heat exchanger, while it can prevent the inserted portion of the support member from being removed from the side plate.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the accompanying drawings. In the present invention, an attachment structure is typically used for a heat exchanger (i.e., condenser) of a refrigerant cycle for a vehicle.

Figure 1:
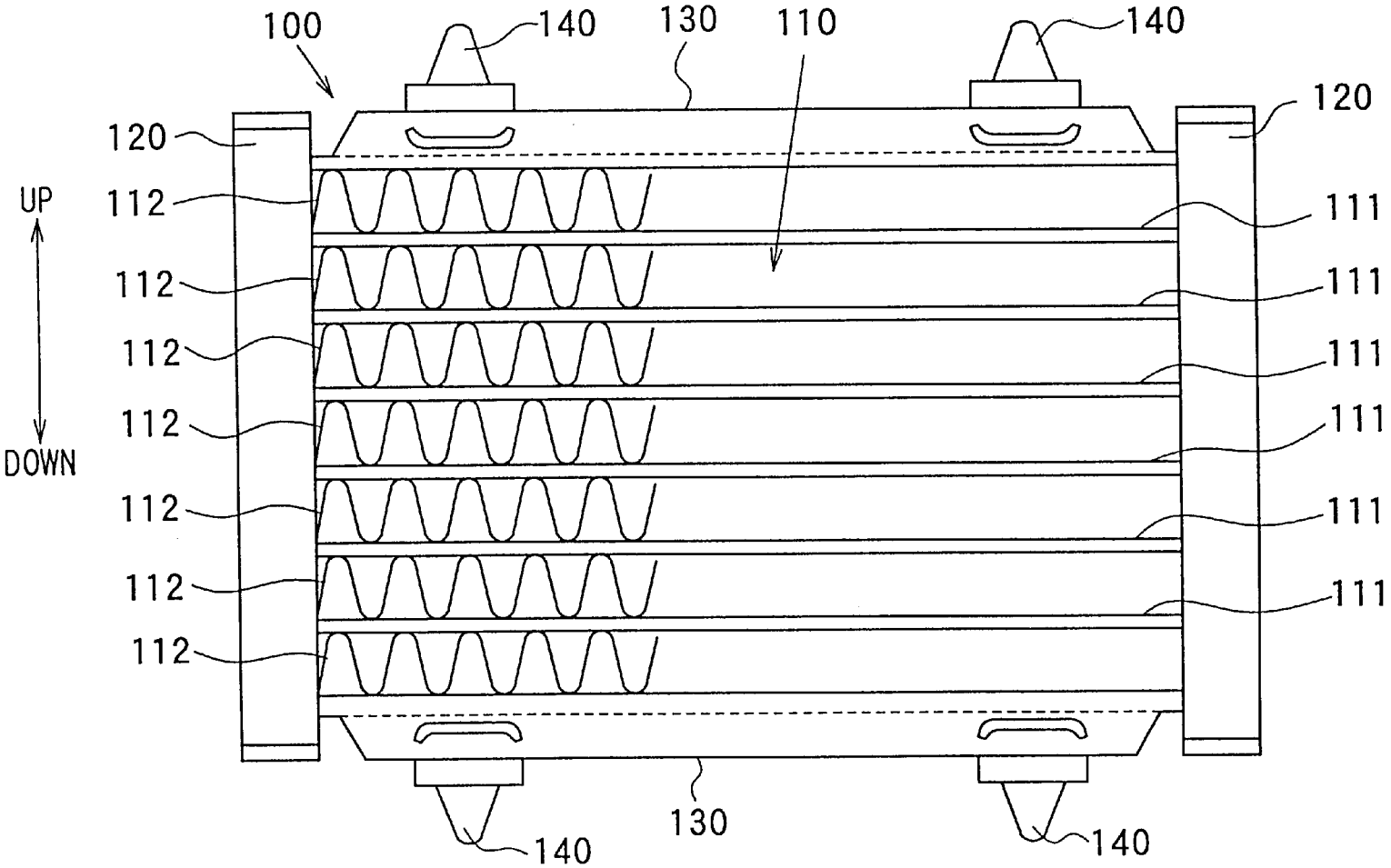
FIG. 1 is a front view of a heat exchanger according to a first preferred embodiment of the present invention.

A first preferred embodiment of the present invention will be now described with reference to FIGS. 1–5. As shown in FIG. 1, a heat exchanger (condenser) 100 includes a heat-exchanging core portion 110 formed into a substantially rectangular shape, for performing a heat exchange between refrigerant and air. The core portion 110 is constructed by plural tubes 111 through which refrigerant flows, and plural corrugated fins 112 each of which is disposed between adjacent tubes 111 to be brazed to the adjacent tubes 111.

Both first and second header tanks 120 are disposed at both longitudinal ends of each tube 111 to communicate with the tubes 111. The first header tank 120 at the right,side in FIG. 1 is disposed to supply and distribute refrigerant discharged from a compressor of a refrigerant cycle into the tubes 111, and the second header tank 126 at the left side in FIG. 1 is disposed to collect refrigerant from the tubes 111 after performing the heat exchange.

Both side plates 130 used as reinforcement members of the core portion 110 are disposed at both upper and lower ends of the core portion 110 to extend in parallel with the tubes 111. The side plates 130 are bonded to the core portion 110 and the first and second header tanks 120 by a brazing, while the core portion 110 and the header tanks 120 are brazed in the brazing.

Figure 2:
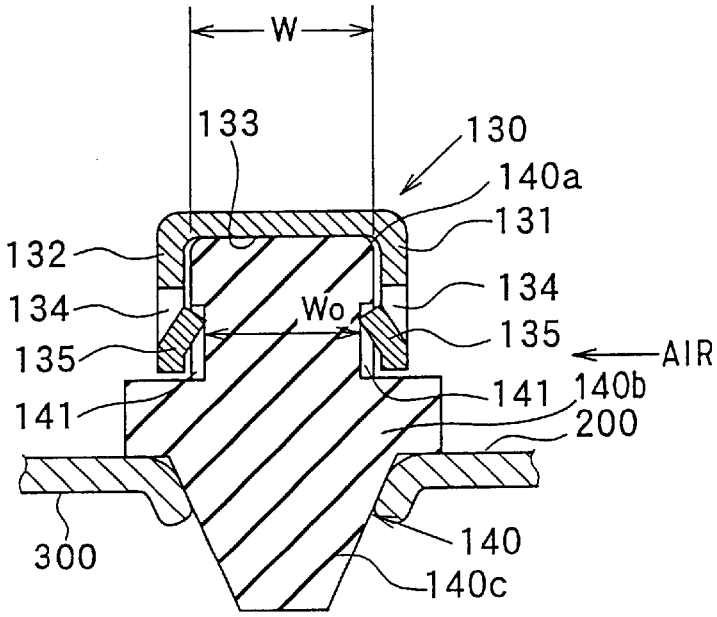
FIG. 2 is a sectional view showing a side plate and a support member of the heat exchanger according to the first embodiment.

Each side plate 130 is formed by a pressing to have approximately a U-shaped cross-section (i.e., one side-opened box sectional shape). As shown in FIG. 2, the side plate 130 has a pair of opposite walls 131, 132 opposite to each other, and a bottom wall 133 connected to the opposite walls 131, 132. That is, the opposite walls 131, 132 protrude, from the bottom wall 133 to be approximately perpendicular to a surface of the bottom wall 133. A support member 140 made of an elastic material is inserted and attached between the opposite walls 131, 132 of the side plate 130 to support the core portion 110 of the heat exchanger 100. The elastic material is an elastically deformed material such as an EPDM (ethylene-propylene-diene copolymer rubber). At both end sides of each side plate 130, both the support members: 140 are attached. Accordingly, in the first embodiment, the total number of the support members 140 is four. Here, an attachment structure of one support member 140 attached to the side plate, 130 is described.

Figure 3:
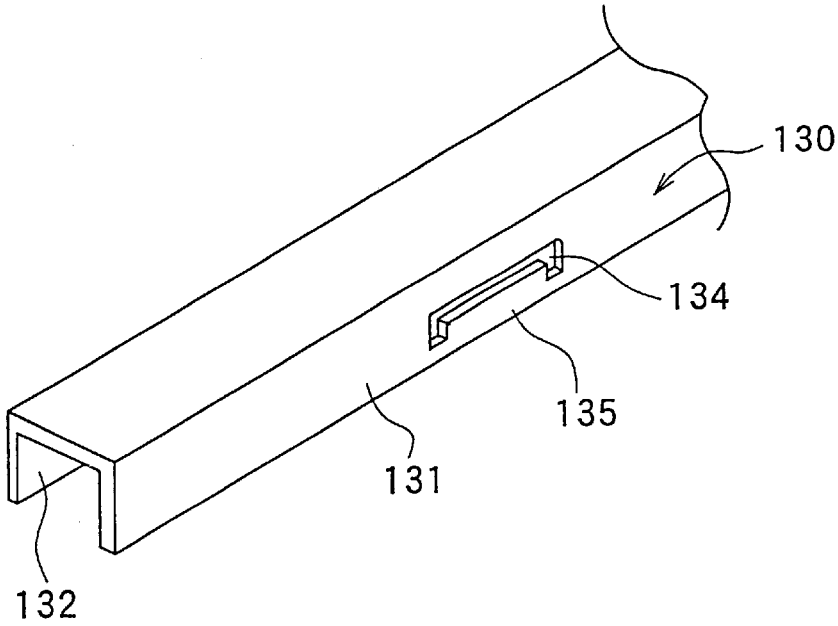
FIG. 3 is a perspective view of the side plate in the heat exchanger according to the first embodiment.

As shown in FIG. 3, a slit portion (penetrating hole portion) 134 is formed in each of the opposite walls 131, 132 into an approximate U-shape. The slit portion 134 has an elongated slit extending in the longitudinal direction of the side plate 130, and side slits extending from ends of the elongated slit in a direction approximately perpendicular to the elongated slit. A piece (rectangular piece) 135 having an approximate rectangular shape is formed at a peripheral end side of the side plate 130 in each opposite wall 131, 132 to define the slit portion 134 in each opposite wall 131, 132. The side plate 130 is formed to have the opposite walls 131, 132 and the bottom wall 133 by pressing, after the slit portions 134 are punched by pressing.

On the other hand, the support member 140 has a width dimension W between the opposite walls 131, 132 at a position adjacent the bottom wall 133 in a direction perpendicular the opposite walls 131, 132. The width dimension W of the support member 140 is reduced at a position corresponding to the rectangular pieces 135 of the support member 140 to form recess portions 141. Therefore, at the positions where the recess portions 141 are formed, the support member 140 has a width dimension Wo smaller than the width dimension W.

The rectangular pieces 135 are plastically deformed to protrude to the recess portions 141 to be fitted into the recess portions 141 and to be engaged with the recess portions 141, after the support member 140 is inserted between the opposite walls 131, 132 of the side plate 130. That is, the rectangular pieces 135 of the opposite walls 131, 132 are plastically deformed to caulk the recess portions 141, so that the support member 140 is fixed to the side plate 130.

As shown in FIG. 2, the support member 140 is disposed between the side plate 130 and a vehicle body 300 to support the core portion 110 of the heat exchanger 100. The support member 140 includes a fixing portion 140*a* inserted between the opposite walls 131, 132 to be fixed into the side plate 130, a substantial conical mount guide portion 140*c* inserted into a hole of the vehicle body 300, and a cylindrical vibration reducing portion 140*b* for absorbing a vehicle vibration.

In a general vehicle, a hardness H of the vibration reducing portion 140*b* is need to be set in a range of $Hs50<H\leqq Hs70$. Accordingly, in the first embodiment, the fixing portion 140*a*, the vibration reducing portion 140*b* and the mount guide portion 140*c* are integrally formed by an elastic material having a hardness about Hs60.

Figure 4:
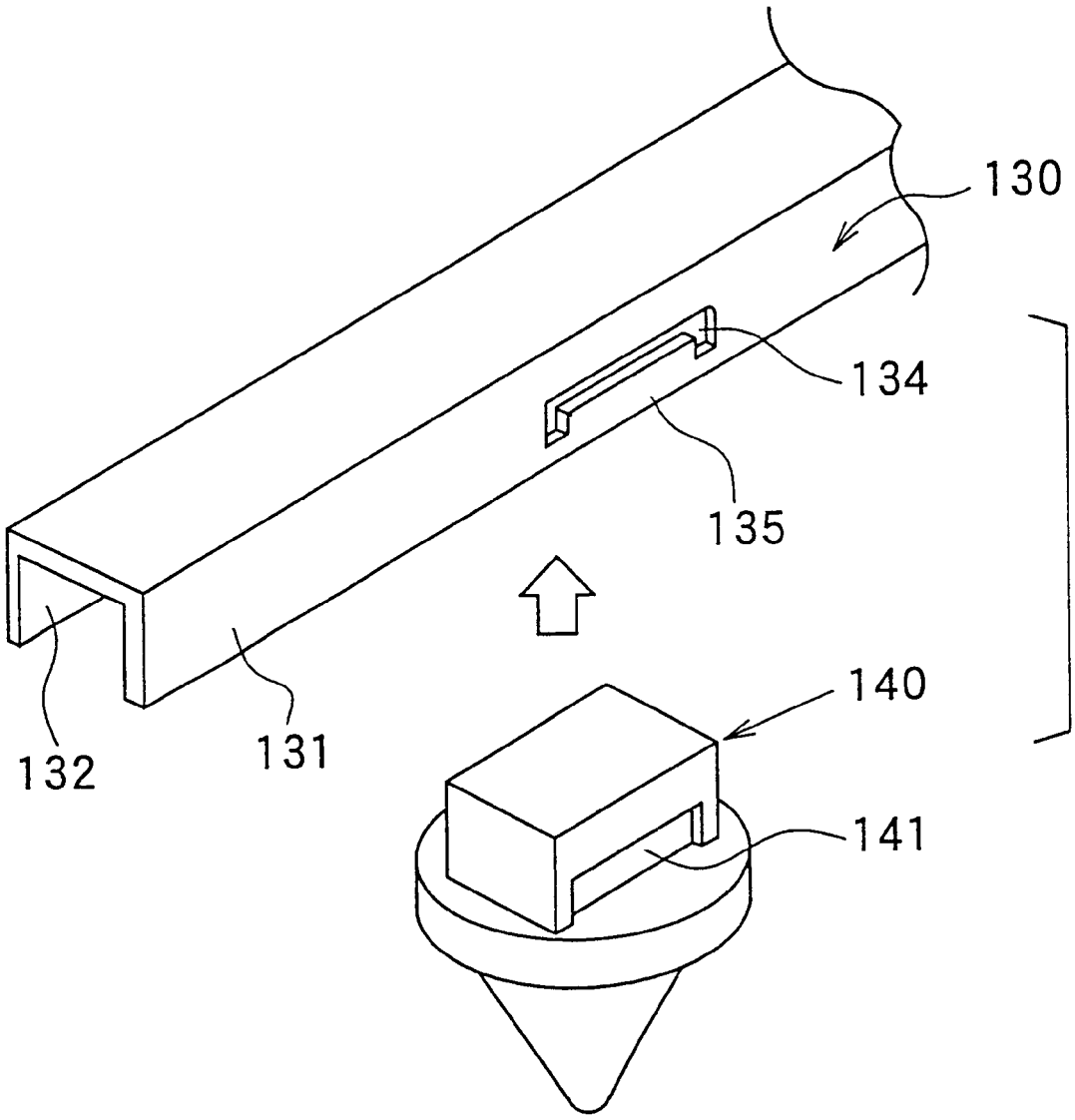
FIG. 4 is a view for explaining an attachment method of the support member to the side plate in the heat exchanger according to the first embodiment.
Figure 5:
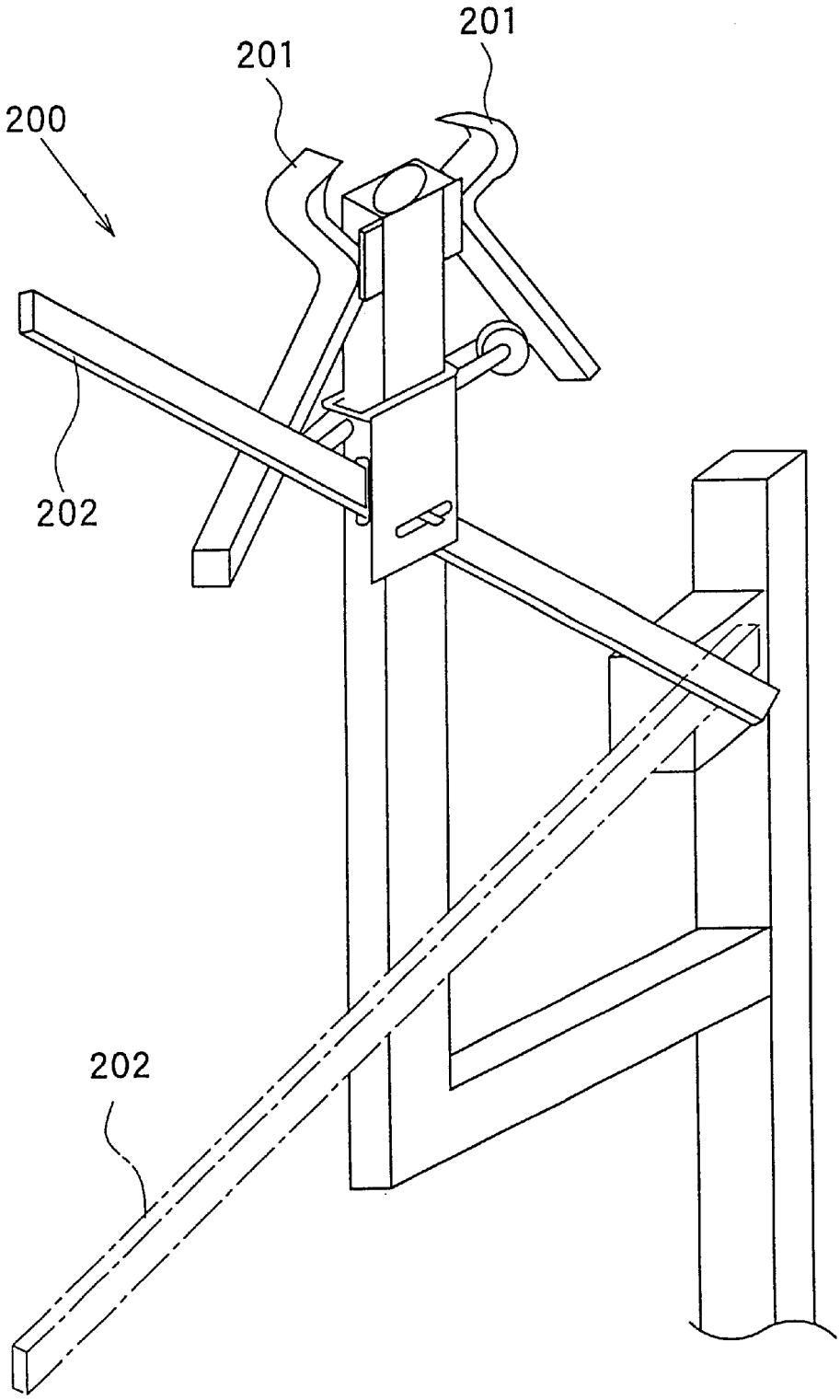
FIG. 5 is a schematic view of a caulking jig for plastically deforming the side plate in the heat exchanger, according to the first embodiment.

Next, an attachment method of the support member 140 will be now described. As shown in FIG. 4, the fixing portion 140*a* of the support member 140 is inserted into the opposite walls 131, 132 of the side plate 130 where the slit portions 134 are formed in the opposite walls 131, 132. Next, the rectangular pieces 135 (peripheral parts of the slit portions 134) are pressed by a caulking jig 200 shown in FIG. 5, so that the rectangular pieces 135 of the opposite walls 131, 132 are plastically deformed toward the recess portion 141 as shown in FIG. 2. As shown in FIG. 5, the jig 200 includes claw portions 201 for plastically deforming the rectangular pieces 135 by contacting and pressing the rectangular pieces 135, and a lever 202 operatively linked with the claw portion 201. When the lever 202 is operated from a lower position indicated by the chain line in FIG. 5 to an upper position indicated by the solid line in FIG. 5, the claw portions 201 press the rectangular pieces 135 to caulk the recess portion 141.

In the first embodiment, the lever 202 is disposed to be manually operated. However, the lever 202 may be disposed to be automatically operated by an actuator using an air cylinder, an oil compression cylinder or the like.

According to the first embodiment of the present invention, the rectangular pieces 135 are fitted into the recess portions 141 of the support member 140 by plastically deforming a part of the opposite walls 131, 132, so that the support member 140 is attached into the side plate 130 without forming an opened recess opened at the outer peripheral ends of the opposite walls 131, 132. Accordingly, it can prevent the side plate 130 from being deformed during a brazing, and the support member 140 can be attached to the side plate 130 by a simple method plastically deforming a part of the opposite walls 131, 132.

In the first embodiment, the slit portions 134 are provided in the opposite walls 131, 132: of the side plate 130 for readily deforming the parts of the opposite walls 131, 132 corresponding to the rectangular pieces, 135. Because the slip portions 134 are provided in the opposite walls 131, 134 of the side plate 130 to have a closed outer peripheral end in the side plate 130, it can prevent the rigidity of the side plate 130 from being greatly decreased.

According to the first embodiment, after the fixing portion 140*a* of the support member 140 is inserted between the opposite walls 131, 132 of the side plate 130, the rectangular pieces 135 are plastically deformed. Therefore, it is unnecessary to elastically deform the support member 140 when the support member 140 is inserted into the side plate 130, and the support member 140 can be readily inserted between the opposite walls 131, 132 of the side plate 130.

According to the first embodiment, the,recess portion 141 is provided in the fixing portion 140*a* of the support member 140 to be recessed to an inner radial side, and the rectangular pieces 135 of the side plate 130 are plastically deformed to be engaged with the recess portions 135, respectively. Accordingly, the elastic material for forming the support member 140 can be relatively reduced, while the attachment structure of the support member 140 to the side plate 130 can be made simple.

A second preferred embodiment of the present invention will be now described with reference to FIGS. 6 and 7. The vibration absorbing capacity (vibration reducing capacity) of the support member 140 becomes larger as the hardness H of the elastic support member 140 becomes smaller. However, when the hardness H of the fixing portion 140*a* becomes smaller, the support member 140 is readily detached from the side plate 130.

Figure 6:
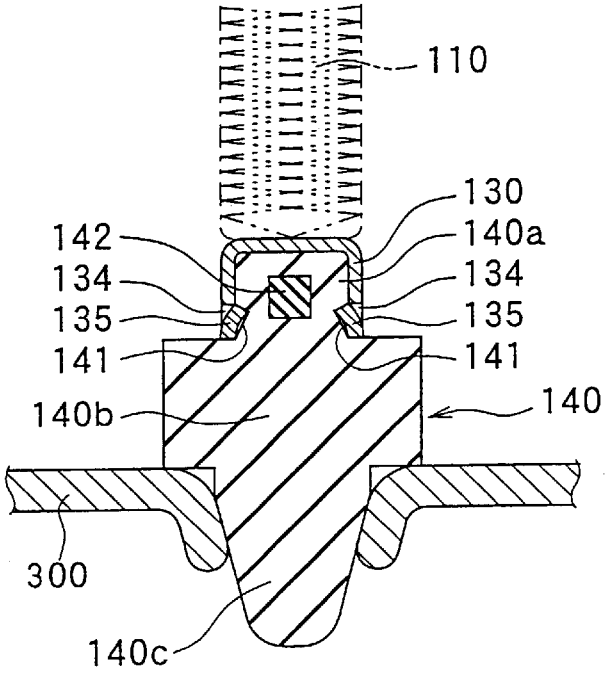
FIG. 6 is a sectional view showing a side plate and a support member of a heat exchanger according to a second preferred embodiment of the present invention.
Figure 7:
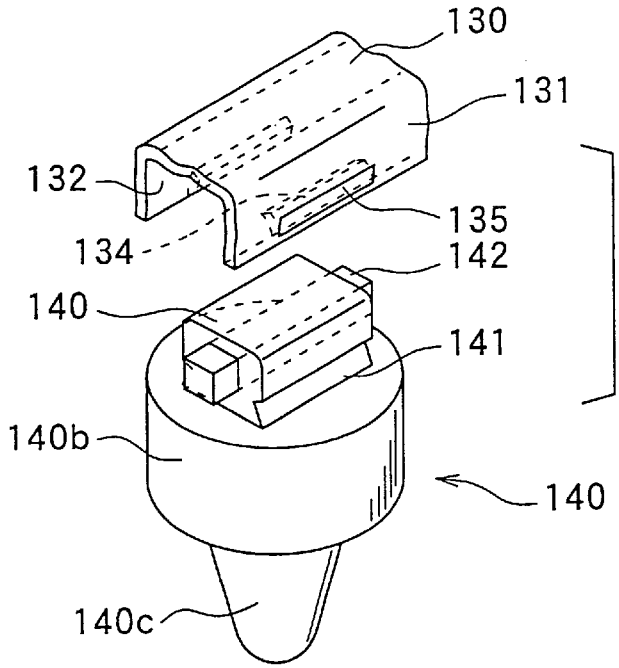
FIG. 7 is a disassembled perspective view showing the side plate and the support member according to the second embodiment.

In the second embodiment, as shown in FIGS. 6 and 7, a hard reinforcement member 142 made of a material having a hardness larger than that of the support member 140 is inserted and fitted into the fixing portion 140*a* of the support member 140 to increase the hardness of the fixing portion 140*a*. Accordingly, the hardness of the vibration reducing portion 140*b* of the support member 140 can be made small (e.g., ≦Hs50), while it can prevent the hardness H of the fixing portion 140*a* from being decreased. Thus, the vibration absorbing capacity of the support member 140 can be increased, while it can prevent the support member 140 from being detached from the side plate 130.

As the material for forming the hard reinforcement member 142, a resin having a heat resistance, such as nylon, PPE, PPO and PPS, a resin with a glass fiber such as PP/GF and PBT/GF, or a metal can be used. In the second embodiment, the hard reinforcement member 142 is formed into a square pillar, however, may be formed into the other shape such as a cylindrical shape, a pipe shape.

Figure 8:
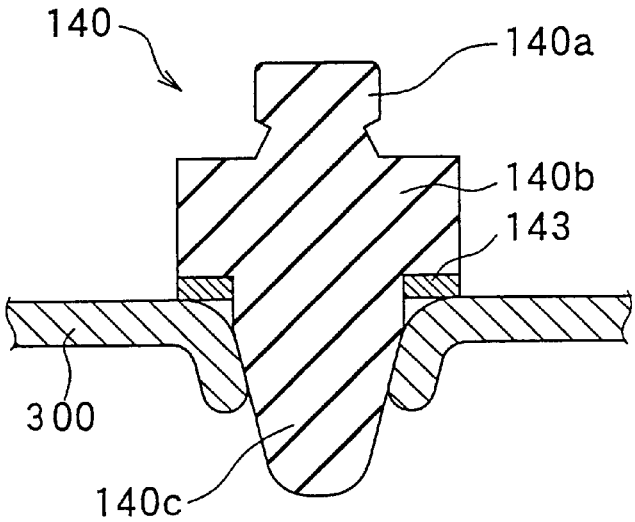
FIG. 8 is a sectional view showing a support member of a heat exchanger according to a third preferred embodiment of the present invention.

A third preferred embodiment of the present invention will be now described with reference to FIG. 8. As shown in FIG. 8, a ring reinforcement plate 143 made of a material having a hardness larger than that of the support member 140 is disposed between the vibration reducing portion 140*b* of the support member 140 and the vehicle body 300 to be boned to the vibration reducing portion 140*b* by a bonding method such as a vulcanization bonding. As a material for forming the reinforcement plate 143, a metal or a hard resin can be used.

Accordingly, even when the hardness of the vibration reducing portion 140*b* of the support member 140 is made small (e.g., equal to or lower than Hs50), because the reinforcement plate 143 is attached to the vibration reducing portion 140*b* between the vibration reducing portion 140*b* and the vehicle body 300, it can prevent the support member 140 from being embedded in the hole of the vehicle body 300. As a result, it can prevent, the fixing portion 140*a* from being removed from the side plate 130.

In the third embodiment, the reinforcement plate 143 is bonded to the vibration reducing portion 140*b* of the support member 140. However, the reinforcement member 143 may be only disposed between the vibration reducing portion 140*b* of the support member 140 and the vehicle body 300.

Figure 9:
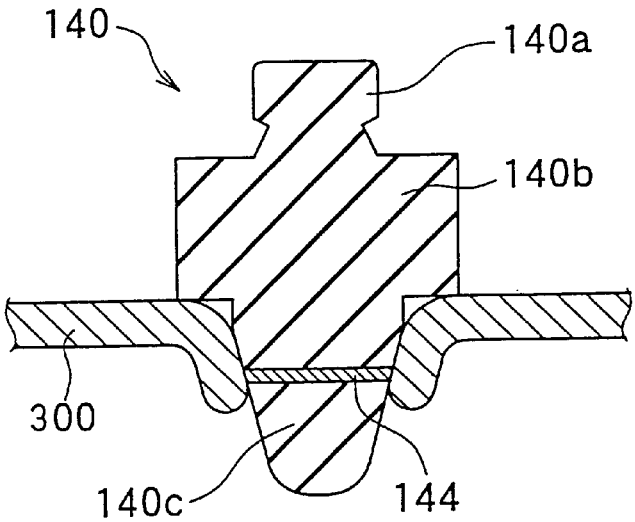
FIG. 9 is a sectional view showing a support member of a heat exchanger according to a fourth preferred embodiment of the present invention.

A fourth preferred embodiment of the present invention will be now described with reference to FIG. 9. As shown in FIG. 9, a reinforcement plate 144 made of a material having a hardness larger than that of the support member 140 is embedded in the mount guide portion 140*c* of the support member 140. As a material for forming the reinforcement plate 144, a metal or a hard resin can be used. Accordingly, the hardness of the mount guide portion 140*c* can be made larger while the hardness of the vibration reducing portion 140*b* of the support member 140 can be made smaller. Therefore, it can prevent the support member 140 from being removed from the hole of the vehicle body 300.

In the fourth embodiment, the reinforcement plate 144 is disposed to extend in a direction perpendicular to an axial direction (paper face-back direction) of the mount guide portion 140*c*. However, the reinforcement plate 144 formed into a pin like may be embedded in the mount guide portion 140*c* to extend in the axial direction of the mount guide portion 140*c*. Further, a hard rubber ring may, be attached to an outer peripheral surface of the mount guide portion 140*c*.

Figure 10:
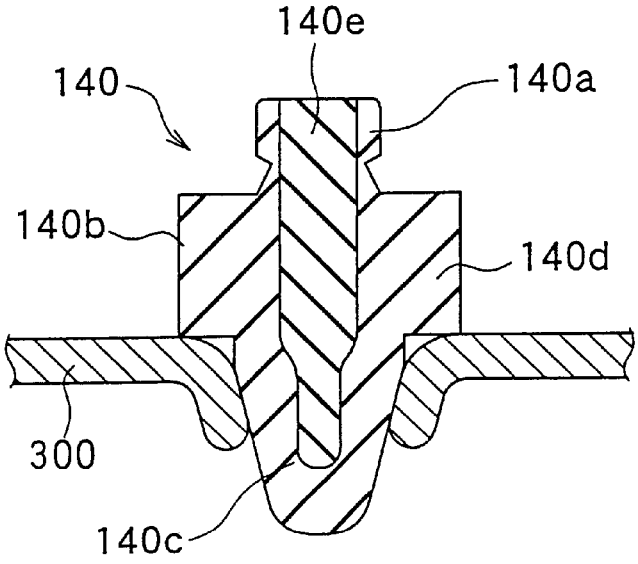
FIG. 10 is a sectional view showing a support member of a heat exchanger according to a fifth preferred embodiment of the present invention.

A fifth preferred embodiment of the present invention will be now described with reference to FIG. 10. As shown in FIG. 10, in the fifth embodiment, the support member 140 has a double structure composed of a soft layer 140*d* having a soft hardness H (e.g., H<Hs50, in the fifth embodiment) and a hard layer 140*e* having a hard hardness (e.g., Hs50≦H≦Hs79).

The hard layer 140*e* is embedded in the soft layer 140*d*, so that the soft layer 140*d* contacts the side plate 130 and the vehicle body 300, and the hard layer 140*e* is positioned away from a contact portion contacting with the side plate 130 or the vehicle body 300.

The double structure of both the soft layer 140*d* and the hard layer 140*e* of the support member 140 can be formed by a co-injection molding. Alternatively, the soft layer 140*d* and the hard layer 140*e* can be integrally formed by vulcanization bonding, after being respectively separately molded. Further, the hard layer 140*e* may be inserted into the soft layer 140*d*, after the soft layer 140*d* and the hard layer 140*e* are receptively molded.

As the material for forming the hard layer 140*e*, a material having a hardness larger than that of soft layer 140*d* may be used. For example, the hard layer 140*e* may be molded by a metal or a hard resin. In the support member 140 of the fifth embodiment, the vibration reducing portion 140*b* may be formed by only the soft layer 140*d*, and the fixing portion 140*a* and the mount guide portion 140*c* may be formed into the double structure with the soft layer 140*d* and the hard layer 140*e*.

Figure 11:
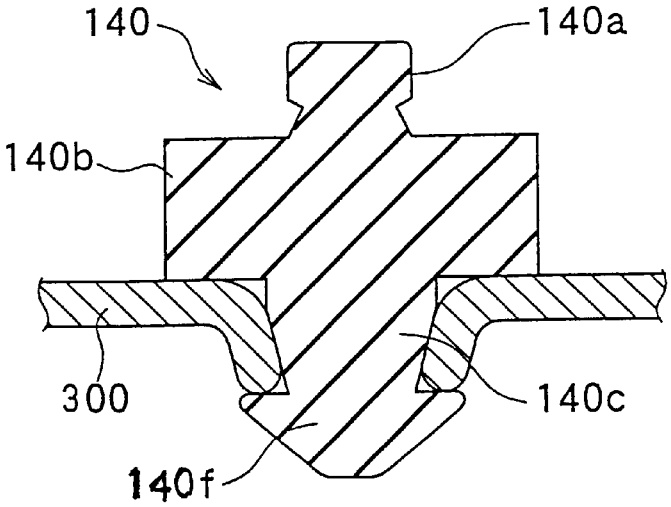
FIG. 11 is a sectional view showing a support member of a heat exchanger according to a sixth preferred embodiment of the present invention.

A sixth preferred embodiment of the present invention will be now described with reference to FIG. 11. As shown in FIG. 11, in the sixth embodiment, an umbrella like ear portion 140*f* having a diameter dimension larger than the hole of the vehicle body 300 is integrally formed with a top end portion of the mount guide portion 140*c*. In this case, it can prevent the support member 440 from being removed from the hole of the vehicle body 300.

Although the present invention has been fully described in connection with the preferred embodiments thereof with reference to the accompanying drawings, it is to be noted that various changes and modifications will become apparent to those skilled in the art.

In the above-described embodiments, the side plate 130 is formed into a one-side opened rectangular sectional shape where both the opposite walls 131, 132 are approximately perpendicular to the bottom wall 133. However, the side plate 130 can be formed into the other shape having the opposite walls 131, 132 opposite to each other. On the other hand, the support member 140 can be made of the other material such as a resin.

In the above-described embodiments, the present invention is typically used for a refrigerant condenser, however, may be used for the other heat exchanger such as a radiator.

Figure 12:
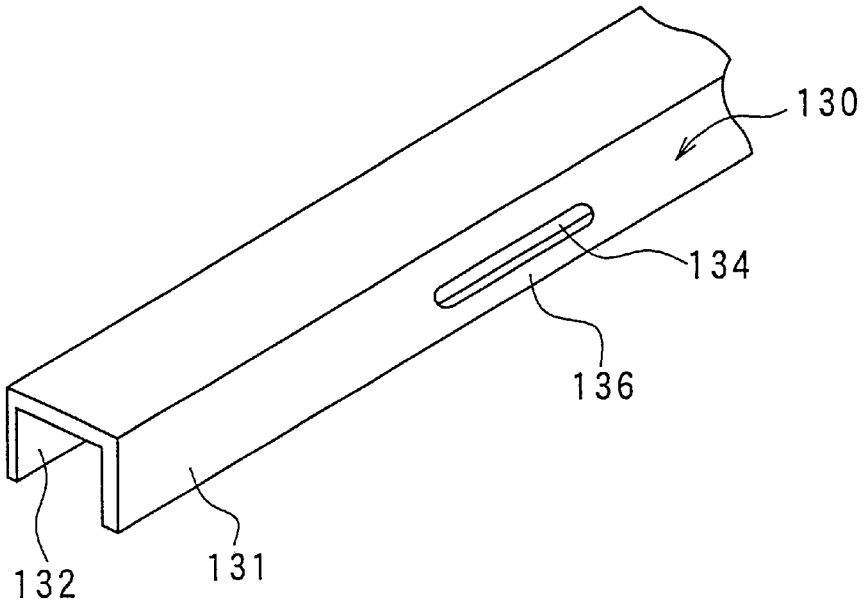
FIG. 12 is a perspective view showing a side plate used in a heat exchanger according to a modification of the present invention.
Figure 13:
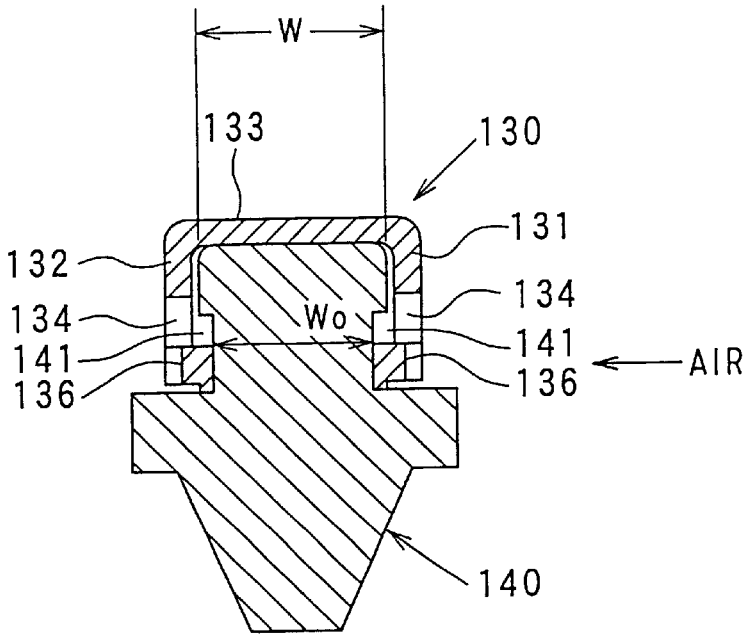
FIG. 13 is a sectional view showing the side plate and a support member of the heat exchanger according to the modification of the present invention.

The slit portion 134. can be formed into a straight line shown in FIG. 12. In this case, portions 136, positioned at the opened end side of the side plate 130 in the opposite walls 131, 132 from the slit portion 134, are plastically deformed to protrude toward the support member 140. Accordingly, as shown in FIG. 13, the portions 136 protruding toward the support member 140 are engaged with the recess portions 141. Further, the slit portion 134 may be omitted. In this case, the opposite walls 131, 132 are plastically deformed at positions corresponding to the recess portions 141 to protrude toward the support member 140 and to be engaged with the recess portions 141.

In the above-described embodiments, the support member 140 may be inserted between both the opposite walls while being elastically deformed, after the rectangular piece 135 is plastically deformed. Further, the sectional shape of each recess portion 141, shown in FIG. 2 or FIG. 6, can be changed.

Such changes and modifications are to be understood as being within the scope of the present invention as defined by the appended claims.

What is claimed is:

1. A heat exchanger comprising:

a core portion in which a first fluid flows, the heater core being disposed to perform a heat exchange between the first fluid and a second fluid passing through the core portion;

a side plate disposed at an end of the core portion, for reinforcing the core portion, the side plate having a pair of opposite walls disposed opposite to each other; and a support member for supporting the core portion, the support member being made of an elastic material and being inserted between the opposite walls of the side plate to have an inserted portion inserted into the side plate, wherein:

the inserted portion of the support member has a recess portion recessed to an inner side; and the opposite walls have a protrusion portion protruding to an inner side between the opposite walls, the protrusion portion being provided to be engaged with the recess portion of the support member.

2. The heat exchanger according to claim 1, wherein the protrusion portion is provided by elastically deforming a part of the opposite walls after the inserted portion of the support member is inserted into the side plate.

3. The heat exchanger according to claim 1, wherein:

each of the opposite walls has a slit penetrating through each opposite wall; and the protrusion portion is provided in the opposite walls at a position proximate to the slit to protrude to the inner side between the opposite walls.

4. The heat exchanger according to claim 3, wherein the protrusion portion is provided by plastically deforming a part of the opposite walls around the slit after the inserted portion of the support member is inserted into the side plate.

5. The heat exchanger according to claim 3, wherein:

the side plate has a connection wall connecting one side end of each opposite wall to form an approximate U-shaped cross section; and the slit is provided in each opposite wall to be positioned inside the other side end of each opposite wall.

6. The heat exchanger according to claim 5, wherein the slit is provided in each opposite wall to have an approximate U shape.

7. The heat exchanger according to claim 5, wherein the slit has an elongated slit portion elongated in a direction and both side slit portion extending from both ends of the elongated slit portion in a direction approximately perpendicular to the elongated slit portion.

8. The heat exchanger according to claim 1, wherein:

the inserted portion of the support member has a dimension between the opposite walls, the insertion dimension being approximately equal to a dimension between the opposite walls; and the recess portion is provided to be recessed from an outer wall surface to the inner side between the opposite walls.

9. The heat exchanger according to claim 1, wherein:

the support member includes the inserted portion inserted between the opposite walls to be fixed therebetween, a mount guide portion being attached to a vehicle body, and a vibration absorbing portion between the inserted portion and the mount guide portion; and the inserted portion of the support member has a reinforcement portion made of a material harder than the elastic material.

10. The heat exchanger according to claim 1, wherein:

the support member includes the inserted portion inserted between the opposite walls to be fixed therebetween, a mount guide portion being attached to a vehicle body, and a vibration absorbing portion between the inserted portion and the mount guide portion; and the vibration reducing portion has a reinforcement portion made of a material harder than the elastic material, the reinforcement portion is provided at a position proximate to the vehicle body opposite to the vehicle body.

11. The heat exchanger according to claim 1, wherein:

the support member includes the inserted portion inserted between the opposite walls to be fixed therebetween, a mount guide portion being attached to a vehicle body, and a vibration absorbing portion between the inserted portion and the mount guide portion; and the mount guide portion has a reinforcement portion. made of a material harder than the elastic material.

12. An attachment method for attaching a support member made of an elastic material into a side plate bonded to a core portion performing a heat exchange between both fluids, the side plate having a pair of opposite walls opposite to each other, the attachment method comprising:

inserting the support member into the side plate between the opposite plates; and plastically deforming a part of each opposite wall using a jig so that the part of each opposite wall protrudes toward the support member to be engaged with a recess portion of the support member.

13. The attachment method according to claim 12, wherein:

each of the opposite walls has a slit penetrate through each opposite wall, the slit is positioned inside of an opened end of each opposite wall to be enclosed by each opposite wall; and in the plastically deforming, each opposite wall around the slit is plastically deformed to form a protrusion protruding toward the support member and engaging with the recess portion.

* * * * *

UNITED STATES PATENT AND TRADEMARK OFFICE

CERTIFICATE OF CORRECTION

PATENT NO. : 6,408,933 B2
DATED : June 25, 2002
INVENTOR(S) : Shokichi Fukuoka et al.

It is certified that error appears in the above-identified patent and that said Letters Patent is hereby corrected as shown below:

Title page,
Item [73], Assignee, add the following -- Gomunoinaki Co., Ltd., Nagoya, Japan --

Signed and Sealed this

Eighteenth Day of March, 2003

JAMES E. ROGAN
*Director of the United States Patent and Trademark Office*